United States Patent [19]

Blink et al.

[11] 4,120,249

[45] Oct. 17, 1978

[54] FOLDING TABLE EQUIPPED WITH IMPROVED LATCH MECHANISM THAT HOLDS TABLE TOP SECTIONS COPLANAR AND PREVENTS ACCIDENTAL INJURY DURING UNFOLDING

[75] Inventors: Robert O. Blink, Greenfield; William C. Lutzke, Milwaukee, both of Wis.

[73] Assignee: Mitchell Manufacturing Company, Milwaukee, Wis.

[21] Appl. No.: 822,443

[22] Filed: Aug. 8, 1977

[51] Int. Cl.[2] ..... A47B 3/091

[52] U.S. Cl. ..... 108/113; 108/130

[58] Field of Search ..... 108/113; 297/159

[56] References Cited

U.S. PATENT DOCUMENTS

| | | | |
|---|---|---|---|
| 2,596,250 | 5/1952 | Klingler | 108/113 X |
| 2,878,859 | 3/1959 | Howe et al. | 297/159 |
| 3,075,809 | 1/1963 | Wilson | 297/159 |
| 3,557,720 | 1/1971 | Blink et al. | 108/113 |
| 3,861,325 | 1/1975 | Bue et al. | 108/113 |
| 4,027,600 | 6/1977 | Mueller | 108/113 |

*Primary Examiner*—Francis K. Zugel

*Attorney, Agent, or Firm*—Ira Milton Jones

[57] ABSTRACT

A folding table having a top formed by a pair of hingedly connected sections, the adjacent edges of which approach one another as the table is unfolded and its top sections are brought into coplanar orientation, is equipped with a latch that is mounted at the underside of the top sections and comprises complementary interengageable relatively movable elements which, upon interengagement, hold the table top sections against unintended displacement from coplanar orientation. One of the latch elements is biased to a position in which an edge thereof lies in the path of the other latch element during relative movement of the latch elements towards interengagement, and thereby blocks movement of the approaching edges of the table top sections beyond a point at which the space therebetween is wide enough to avoid pinching one's fingers. A handle operatively connected with the biased latch element and movably mounted at the underside of one of the table top sections, enables the biased latch element to be moved out of its blocking position, the handle being located far enough from the adjacent edges of the table top sections to prevent any part of the hand used to activate the handle being pinched between said approaching table top edges.

6 Claims, 6 Drawing Figures

Fig. 1
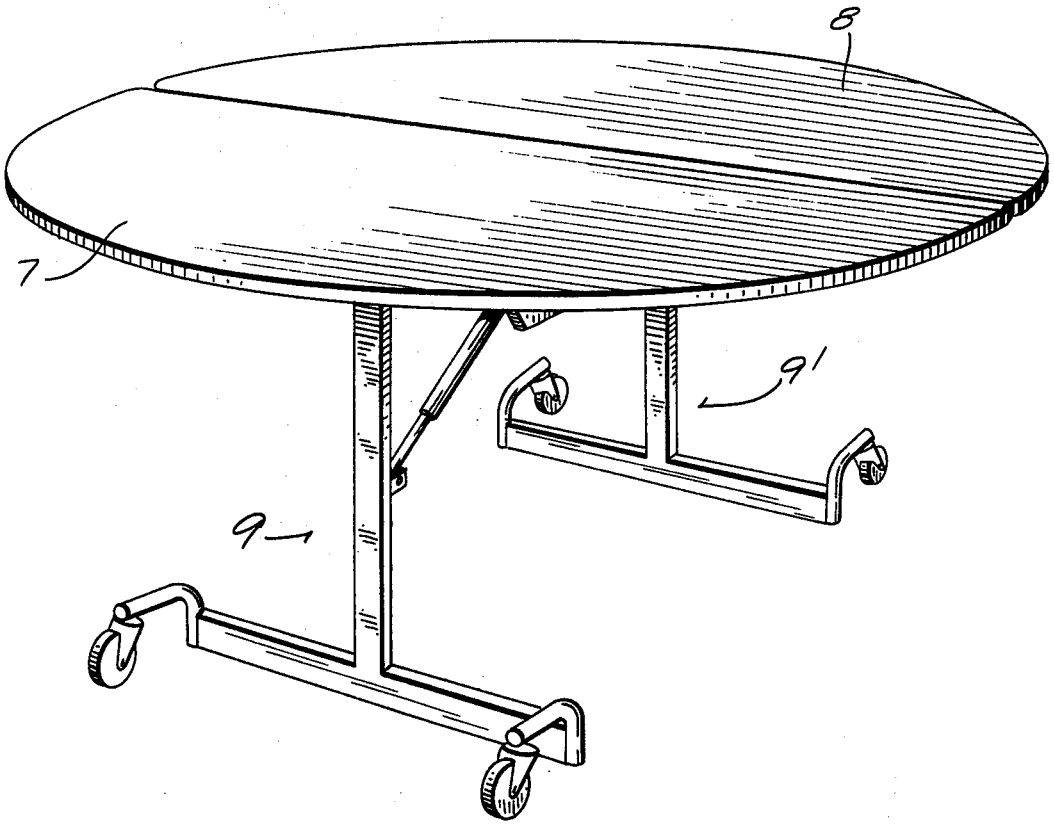
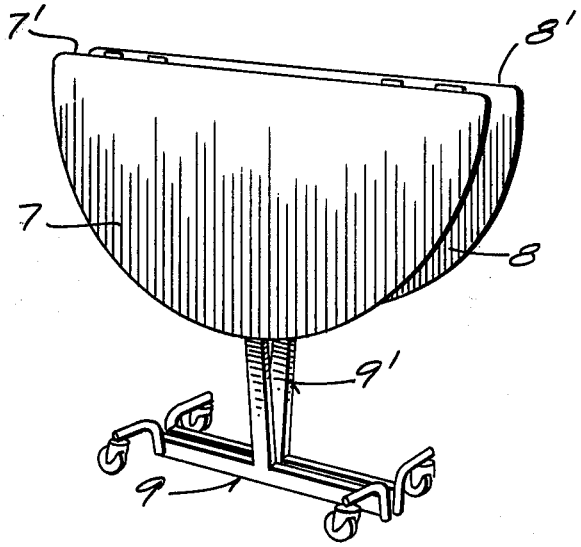
Fig. 2

FOLDING TABLE EQUIPPED WITH IMPROVED LATCH MECHANISM THAT HOLDS TABLE TOP SECTIONS COPLANAR AND PREVENTS ACCIDENTAL INJURY DURING UNFOLDING

This invention relates to folding tables of the type in which the top is formed of hingedly connected sections, the adjacent edges of which move towards one another as the table is unfolded and abut when the table top sections reach coplanar orientation. Examples of such folding tables will be found in the James U.S. Pat. No. 2,811,400; the Wilson U.S. Pat. No. 3,075,809; the Blink et al U.S. Pat. Nos. 3,143,982 and 3,557,720; and the Bue et al U.S. Pat. No. 3,861,325.

However, none of the above identified patents discloses any appreciation of the problem dealt with by this invention, much less its solution. That problem stems from the fact that the movement of the adjacent edges of the hingedly connected table top sections towards one another as the table is unfolded, constitutes a safety hazard. The danger of having one's fingers pinched between the approaching edges of the table top sections during the act of unfolding the table is very real.

Elimination of the possibility of such injury is the basic purpose and object of this invention.

A more specific objective is to combine in a single, easily constructed and reliably operative mechanism, a latch which — upon being engaged — holds the hingedly connected table top sections against unintentional displacement from coplanar orientation, and a motion interrupting stop device that blocks movement of the table top sections towards coplanar orientation before the gap between their adjacent edges narrows to a finger-pinching width.

It is also an objective of this invention to provide the table with at least one manually operable handle positioned beneath one of the table top sections and operatively connected with the combined latch and motion interrupting stop device, to enable the latter to be deactivated and permit the latch elements to be engaged, which handle is so located that no part of a hand used to actuate it can be caught or pinched between the adjacent edges of the table top sections.

It is also a feature of the invention that one of the coacting elements of the latch is spring-biased to a defined operative position in which position an integral part thereof constitutes the motion interrupting device, so that for the latch to be engaged — and also disengaged — that spring-biased latch element must be moved out of its defined operative position against the biasing force acting thereon.

With a view to achieving the reliable simplicity that characterizes this invention, the spring-biased latch element is mounted to swing about a fixed axis and the handle by which it is moved out of its defined operative position is a rock shaft or rod rotatably mounted at the underside of one of the table top sections. A crank at the inner end of this rod passes through a hole in the spring-biased latch element. Rotation of the rod in the proper direction thus retracts the spring-biased latch element; and to enable such rotation to be conveniently applied to the rod, its outer end portion which is shaped to provide a hand grip, is located a short distance inwardly of the adjacent edge of the table top section.

Preferably the latch mechanism should be operable from either of two opposite sides of the table, an objective which this invention has attained in an exceptionally practical way by simply rotatably mounting a second rock shaft or rod coaxially with the first; and to avoid an otherwise difficult construction, the cranks of the two rods are pinned together so that only one of them needs to be — and is — drivingly connected with the spring-biased latch element.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of the embodiment of the invention constructed according to the best mode so far devised for the practical application of the principles thereof, and in which:

FIG. 1 is a perspective view of a folding table embodying this invention and showing the same unfolded, with its hingedly connected top sections coplanar;

FIG. 2 is a perspective view of the same table, folded for storage;

Figure 3:
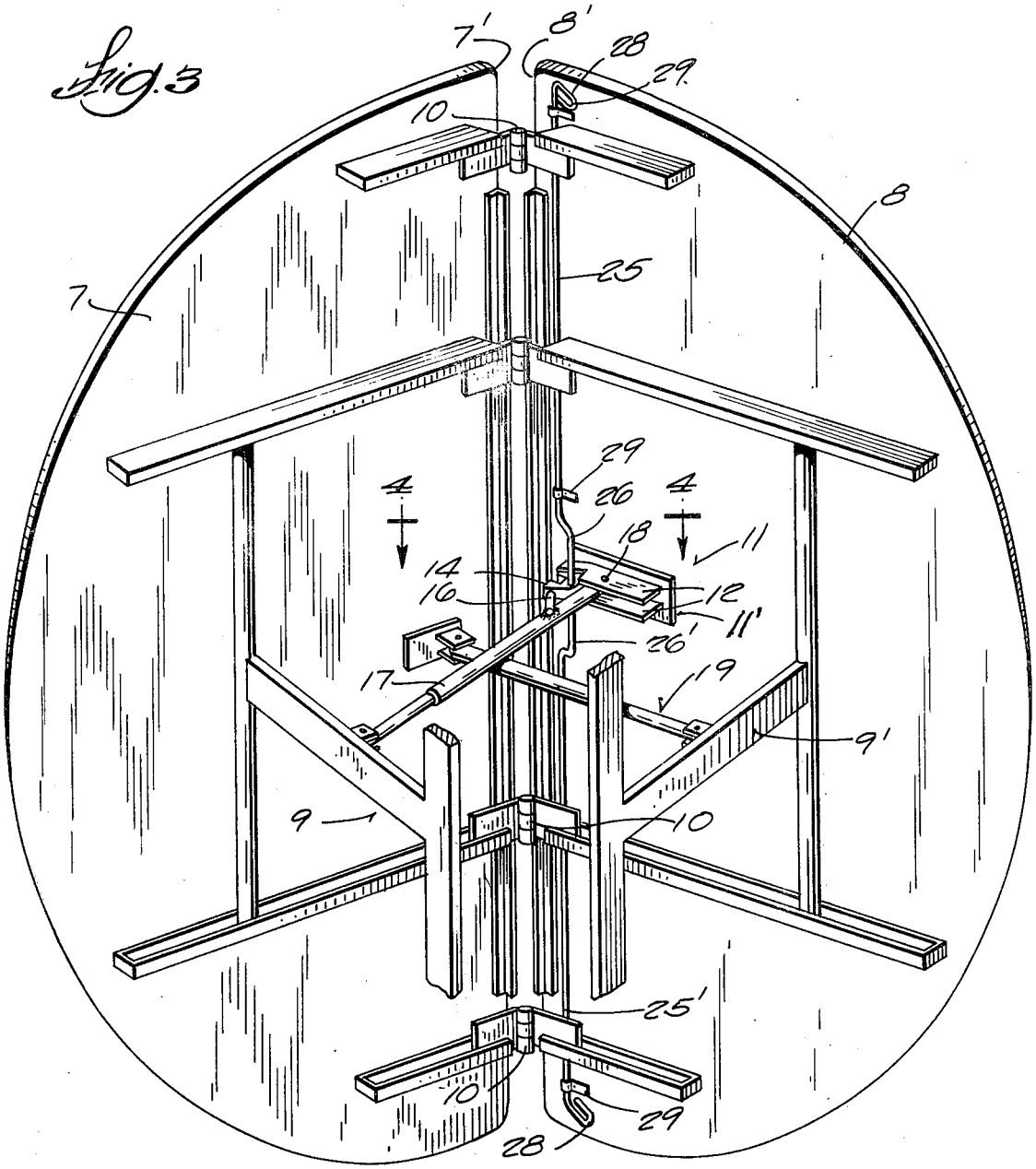
FIG. 3 is a perspective view of the underside of the table in a partially unfolded condition.

Before describing the invention by reference to the drawings, it would be well to explain that the invention consists in equipping a folding table having a top formed by a pair of hingedly connected leaves or table top sections, the adjacent edges of which approach one another as the table is unfolded, with a combined latch and motion interrupting mechanism which comprises the combination of latch means at the underside of the table top sections, which upon being engaged hold the table top sections against unintentional displacement out of coplanar orientation; blocking means associated with said latch means and operable, until disabled, to prevent engagement of said latch means and movement of the table top sections into coplanar orientation; and manually operable means for disabling said blocking means.

Referring now to the accompanying drawings, the numerals 7 and 8 designate complementary leaves or table top sections which together form the top of the table in its unfolded condition, shown in FIG. 1, in which condition the table top is supported by a pair of legs 9 and 9' that are respectively hinged to the underside of the sections 7 and 8. As is conventional in such tables, the leaves 7 and 8 are connected by a plurality of hinges 10 to swing about an axis that is parallel to and spaced down from the adjacent edges 7' and 8' of the complementary table top sections.

By virtue of the location of the hinge axis, the edges 7' and 8' abut in the unfolded condition of the table and are spaced a substantial distance apart when, as shown in FIG. 2, the table is folded for storage.

Obviously, therefore, as the table is unfolded, the edges 7' and 8' approach one another and, in doing so, constitute a safety hazard. The fingers of a person unfolding the table could be severely pinched between those edges, unless that person carefully kept his hands well spaced from the danger zone; or the table was equipped with means to interrupt the unfolding motion when the space between the approaching edges was still wide enough to be safe, and continuance of the unfolding operation entailed the performance of an act that necessitated keeping the hand used to perform that act well spaced from the danger zone.

Not only is the table of this invention equipped with such means for interrupting the unfolding of the table before fingers can be pinched, but — in addition — it incorporates that means in a novel way with a latch device by which the table top sections are held against unintended displacement out of coplanar orientation.

The structure that performs those two functions comprises a bracket 11 having a mounting plate 11' that is fixed to the underside of the table top section 8 near its edge 8', and opposed downwardly projecting flanges 12. Pivotally mounted between these flanges by a pin 13 is a lever 14 that forms one of the two coacting elements of the latch device, and — more specifically — constitutes the keeper portion of the latch. The other element of the latch device, which may be considered its bolt — is the bight portion 15 of a U-shaped member 16, the legs of which straddle and are welded to a strut or brace 17.

The adjacent end of the strut or brace 17 is received between the flanges 12 and is pivoted thereto, as at 18. Its opposite end is pivotally connected to the leg 9 that is hingedly connected to the table top section 7. Another strut or brace 19 is pivotally connected at one end to the leg 9' that is hingedly connected to the table top section 8, and at its other end to the table top section 7. As will be readily appreciated, by virtue of this linkage between the legs and the hingedly connected table top sections, the legs and the table top sections are held in mutually perpendicular relationship when the table is unfolded, and when folded for storage the legs and table top sections are in substantially parallel closely spaced relationship.

In the fully unfolded condition of the table, when its hingedly connected sections are coplanar, the coacting elements of the latch device are engaged and thereby hold the table top sections against unintended displacement from their coplanar orientation. The pin 13 by which the lever 14 is pivotally connected with the bracket 11 is so located and disposed with respect to the hinged connection between the table top sections, that the lever is movable towards and from the hinge axis. A spring 20 confined between the mounting plate 11' of the bracket and a socket 21 in the upwardly facing surface of the lever, yieldingly holds the lever in an operative position in which the edge or surface 22 thereof faces the hinge axis between the table top sections and is substantially vertical. That position is defined by the collision of an upwardly facing heel portion 23 of the lever with the mounting plate 11', the heel portion 23 and the spring 20 being at diametrically opposite sides of the pin 13.

A notch 24 in the edge or surface 22 of the lever constitutes the keeper of the latch and hence is of a size to receive the bolt of the latch formed by the bight portion 15 of the U-shaped member 16 that is fixed to the brace 17; but that interengagement of the latch elements is possible only when the table is in its fully unfolded condition, and when it takes place, the entire table structure is solidly held in its operative condition.

Figure 4:
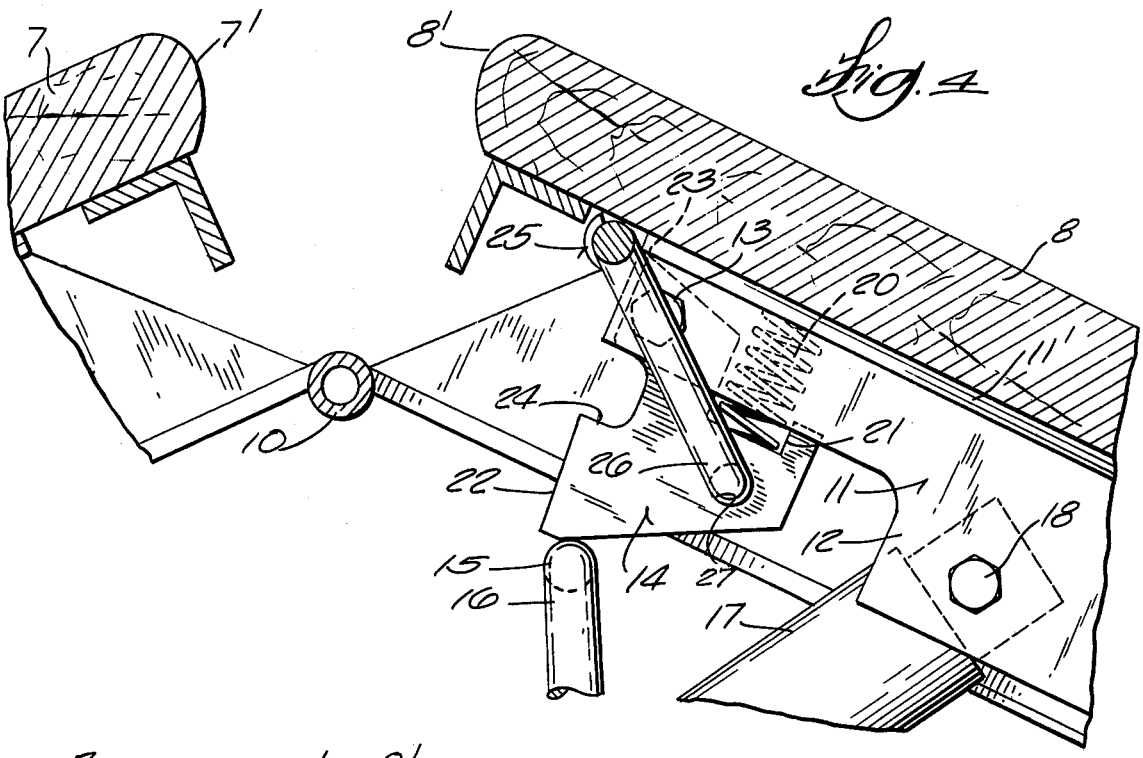
FIG. 4 is a detail sectional view through FIG. 3 on the plane of the line 4—4.
Figure 5:
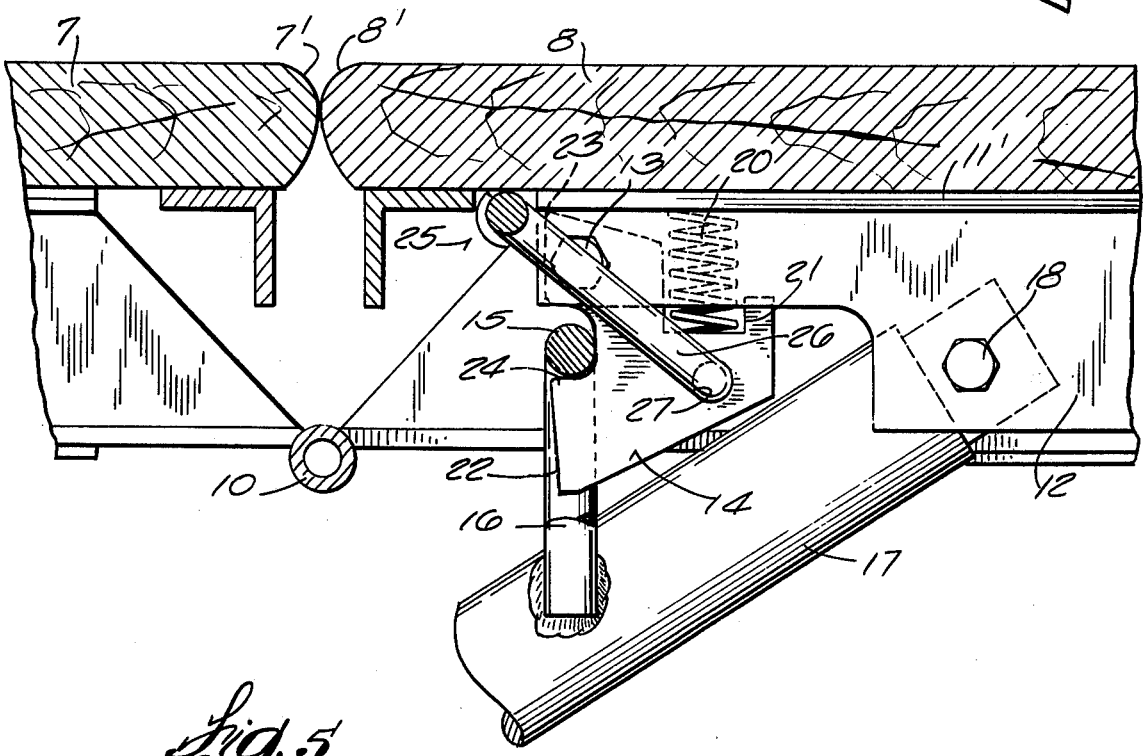
FIG. 5 is a sectional view similar to FIG. 4 but showing the table top sections in coplanar orientation as they are when the table is fully unfolded.

To enable the bolt formed by the bight portion 15 to be received by the notch 24, the notch is so located with respect to the pivotal connection 18 between the brace 17 and the bracket 11 that it lies on the arc described by the bight portion as it swings with the brace about the connection 18. However, as shown in FIG. 4, when the lever 14 is in its defined position in which it is yieldingly held by the spring 20, the downwardly facing surface of the lever lies athwart the path of the approaching bight portion 15 and thus blocks further movement thereof towards the notch. That occurs when the adjacent edges 7'–8' of the table top sections are spaced apart a distance sufficient to preclude fingers being pinched therebetween.

Obviously, therefore, if the latch elements are to be engaged, one of them must be movable to accommodate further relative movement towards full engagement. It is for that reason that the lever 14 is pivotally mounted and spring-biased to its defined operative position. It is movable out of that position to enable engagement of the latch elements and, of course, also to enable disengagement thereof, by manually operable latch releasing means which comprises at least one rock shaft or rod 25 rotatably mounted at the underside of the table top section 8. One end portion of the rod 25 is bent to form a crank 26 that is received in a hole 27 through the lever 14. Since the rock shaft or rod 25 rotates about an axis parallel to the table top edge 8' and closely adjacent to the pivot axis of the lever 14, rotation of the rod in the proper direction, swings the lever 14 away from its defined position against the force of the biasing spring acting thereon. The throw of the crank 26 is sufficient to move the lever 14 out of the path of the bight portion 15, to thus enable entry thereof into the notch 24 — or, if the table is to be folded for storage — to enable disengagement of the bight portion 15 from the notch.

In either case, a handle 28 at the other end of the rod enables the application of torque to the rod. Attraction is directed to the fact that the handle is located near the edge of the table top at a distance far enough from the adjacent edges 7', 8' of the table top sections to assure that no part of the hand used to actuate the handle can be pinched between those edges. When free, the handle diverges away from the underside of the table top section 8, and being located where it is, can be lifted to retract the lever 14 concomitantly with the application of lifting force to the table top sections as the table is folded for storage.

Any suitable means may be employed to rotatably mount the rock shaft or rod 25 at the underside of the table top section 8, but since it is desirable to have the rotation axis of the rod close to that of the pin 13 about which the lever 14 swings, the rod is held against the underside of the table top section by a plurality of clips 29 that are shaped to embrace the rod.

Figure 6:
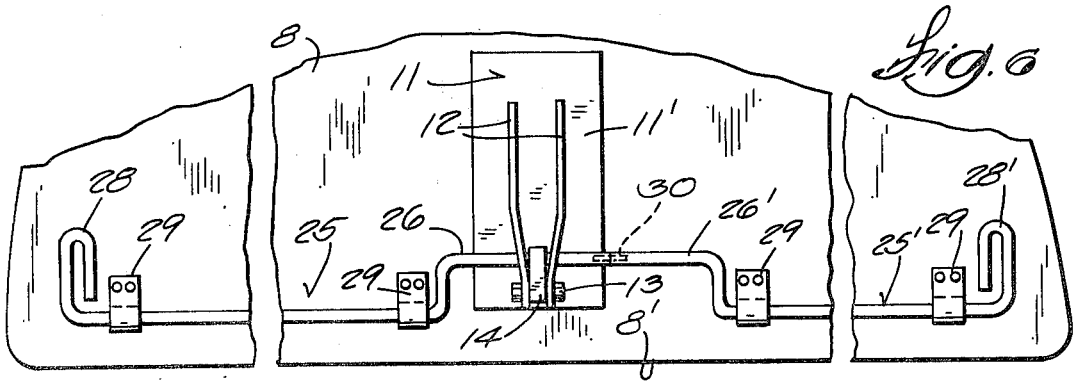
FIG. 6 is a bottom view of a portion of the table top section on which the latch and motion interrupting mechanism is mounted, but with part of that mechanism omitted.

While a single rock shaft or rod 25 is all that is needed to swing the lever 14 from its defined operative position, the addition of a second such rod makes actuation of the lever possible from either of the opposite sides of the table. Accordingly, as best shown in FIG. 6, a second rod 25' is rotatably mounted at the underside of the table top section 8 in coaxial alignment with the first. But note that the crank of only the first rod passes through the hole 27 in the lever 14. However, the crank 26' of the second rod 25' is operatively connected with the lever since the cranks of the two rods are coaxially secured together by a roll pin 30 snugly received in drilled sockets in the ends of the cranks.

By using two separate rods connected in the manner described, an otherwise difficult assembly with the lever 14 is obviated.

Those skilled in the art will appreciate that the invention can be embodied in forms other than as herein disclosed for purposes of illustration.

The invention is defined by the following claims:

We claim:

1. In a folding table of the type in which the top of the table has hingedly connected sections that have adjacent edges and are coplanar when the table is unfolded and set up for use, wherein each of said table top sections has leg means hingedly connected thereto, and leg struts connecting the leg means of one table top section with the other table top, wherein the axis of the hinge connection between the table top sections is so located with respect to the adjacent edges of the table top sections that those edges are closely contiguous when the table top sections are coplanar, improved means for eliminating the hazard of accidentally pinching one's fingers between the adjacent edges of the table top sections as those edges approach contiguity during unfolding of the table, and which comprises:

A. coacting latch elements operable upon being brought into a predetermined engaged relationship, to hold the table top sections against unintended displacement out of coplanar relationship, (1) one of said latch elements being a lever pivotally mounted at the underside of one of the table top sections to swing about an axis spaced from and parallel to that of the hinged connection between the table top sections, to and from a defined position in which one edge of said lever faces the hinge axis but is spaced therefrom, (a) said edge having a notch, and (b) spring means biasing said lever to its said defined position, (2) the other latch element being a bolt of a size to fit in said notch, (a) said bolt being fixed on the leg strut that has one of its ends hingedly connected with the same table top section on which said lever is pivotally mounted and its other end connected with the leg means of the other table top section, and (b) the length of said strut and the locations of its connections with the first identified table top section and the leg means of the other table top section being such that as the table top sections approach coplanar orientation, the bolt carried by said strut collides with said edge of said lever at a point spaced from its notch and thereby blocks further movement of the table top sections towards coplanar orientation as long as said lever remains in its said defined position; and B. means including at least one manually actuatable handle for moving said spring biased lever out of its said defined position, said manually actuatable handle being movably mounted at the underside of one of the table top sections and being connected with said lever to swing the same about its pivotal mounting in opposition to the biasing force thereon, far enough to permit entry of said bolt into said notch during unfolding of the table for use and to permit said bolt to leave said notch preparatory to folding up the table for storage.

2. The invention defined by claim 1, wherein said latch elements are so located with respect to the edge of the table that they cannot be unintentionally reached by a person in the act of unfolding the table for use, and wherein said manually actuatable handle is located at a readily accessible location under a side edge portion of one of said table top sections.

3. The invention defined by claim 2, wherein the location of said handle is also near one of the contiguous edges of said hingedly connected table top sections, so as to be readily manipulateable by a person engaged in setting up the table for use.

4. The invention defined by claim 3, wherein said means for moving said spring biased lever out of its said defined position further comprises (1) a rock shaft rotatably mounted at the underside of said one of the table top sections for rotation about an axis spaced from but parallel with the axis about which said lever pivots, (2) a crank at one end of the rock shaft drivingly connected with said lever at a distance from the axis about which said lever pivots, so that rotation of the rock shaft in one direction swings said lever out of its defined position, and (3) the other end of said rock shaft being shaped to provide said handle.

5. The invention defined by claim 4, wherein said handle projects laterally from the rock shaft and has its free end spaced from the underside of the adjacent table top section when said lever is in its said defined position, so that during manual manipulation of the table top sections, either during folding or unfolding thereof, one hand of the operator is naturally positioned to lift the handle towards the underside of the adjacent table top section and thereby rock the lever out of its said defined position.

6. The folding table of claim 5, wherein there are two coaxial rock shafts, both rotatably mounted at the underside of the same table top section, one at each side of said lever, wherein the crank of only one of said rock shafts is received in the hole in the lever, and wherein the cranks of the two rock shafts are coaxially joined so that torque applied to either rock shaft swings the crank that is received in the hole in the pivoted lever.

* * * * *